US012687325B2

(12) United States Patent
Ciccone

(10) Patent No.: US 12,687,325 B2
(45) Date of Patent: Jul. 21, 2026

(54) ADIABATIC HEAT PUMP

(71) Applicant: Joseph L. Ciccone, Neptune, NJ (US)

(72) Inventor: Joseph L. Ciccone, Neptune, NJ (US)

( * ) Notice: Subject to any disclaimer, the term of this patent is extended or adjusted under 35 U.S.C. 154(b) by 147 days.

(21) Appl. No.: 18/790,856

(22) Filed: Jul. 31, 2024

(65) Prior Publication Data

US 2026/0036341 A1 Feb. 5, 2026

(51) Int. Cl.
*F25B 1/02* (2006.01)

(52) U.S. Cl.
CPC ..... *F25B 1/02* (2013.01); *F25B 2400/0401* (2013.01); *F25B 2400/14* (2013.01); *F25B 2400/16* (2013.01)

(58) Field of Classification Search
CPC ..... F25B 1/04; F25B 1/02; F25B 2400/14; F17C 2227/0164; F17C 7/02
See application file for complete search history.

(56) References Cited

U.S. PATENT DOCUMENTS

| | | | | |
|---|---|---|---|---|
| 4,005,584 | A | 2/1977 | Li | |
| 4,747,271 | A * | 5/1988 | Fischer | F01K 21/005 60/670 |
| 4,945,725 | A * | 8/1990 | Carmein | F01K 21/02 60/512 |
| 10,443,863 | B2 | 10/2019 | Alsaleem et al. | |
| 10,612,821 | B1 | 4/2020 | Fernando | |
| 10,830,503 | B2 | 11/2020 | Kopko | |
| 11,061,392 | B2 | 7/2021 | Yenni et al. | |
| 11,137,164 | B2 | 10/2021 | Lu et al. | |
| 11,274,238 | B2 | 3/2022 | Close et al. | |
| 11,320,170 | B2 | 5/2022 | Kozasa | |
| 2010/0313558 | A1 | 12/2010 | Thiessen | |
| 2010/0326066 | A1 | 12/2010 | Fong et al. | |
| 2010/0329903 | A1 * | 12/2010 | Fong | F01B 17/022 137/12 |
| 2015/0211440 | A1 * | 7/2015 | Joffroy | F25B 1/10 60/526 |
| 2016/0146517 | A1 | 5/2016 | Van Beveren | |

(Continued)

FOREIGN PATENT DOCUMENTS

| | | | |
|---|---|---|---|
| CN | 101907355 | A | 12/2010 |
| CN | 117329604 | A | 1/2024 |

(Continued)

OTHER PUBLICATIONS

Maia, Antonio; Auguto Torres; Silva, Marconi de Assis; Koury, Ricardo Nicolau Nassar; Machado, Luiz; and Eduardo Alexandre Carlos—Title—Control of an Electronic Expansion Valve using an Adaptive PID Controller—Paper 1109—Purdue University—International Refrigeration and Air-Conditioning Conference School of Mechanical Engineering—USA—2010—Web Address: https://docs.lib.purdue.edu/iracc.

*Primary Examiner* — Elizabeth J Martin
*Assistant Examiner* — Keona Lauren Banks
(74) *Attorney, Agent, or Firm* — Ernest D. Buff, Esq.; Ernest D. Buff & Associates, LLC

(57) ABSTRACT

A heat transfer apparatus transfers heat from a heat source to a heat sink. The apparatus comprises a compressor-expander and a reservoir that are connected by two separate fluidic loops for the respective circulation principally of vapor and liquid portions of a working fluid. The loops each contain a heat exchanger through which heat is respectively absorbed and rejected.

24 Claims, 5 Drawing Sheets

(56) References Cited

U.S. PATENT DOCUMENTS

| | | | | |
|---|---|---|---|---|
| 2016/0273529 | A1 | 9/2016 | Stahlkopf et al. | |
| 2017/0002803 | A1 | 1/2017 | Van de Ven et al. | |
| 2018/0328235 | A1 | 11/2018 | Elayahu | |
| 2021/0063063 | A1 | 3/2021 | Gentry | |
| 2024/0318645 | A1* | 9/2024 | Try | F04B 7/02 |

FOREIGN PATENT DOCUMENTS

| | | | |
|---|---|---|---|
| EP | 3702683 | A1 | 9/2020 |
| WO | WO2023041920 | A | 3/2023 |

* cited by examiner

ADIABATIC HEAT PUMP

BACKGROUND OF THE INVENTION

1. Field of The Invention

The present disclosure pertains to a heat engine and a method for operating the same; and, more particularly, to a heat transfer apparatus appointed to transfer heat from a heat source to a heat sink using a working fluid, the apparatus comprising two separate fluidic loops for the respective circulation principally of vapor and liquid portions of the fluid.

2. Description of The Prior Art

Closed cycle, vapor compression heat pumps are widely used in the Heating, Ventilation, and Air Conditioning (HVAC) industry. These conventional systems are based on the circulation of a refrigerant (or working fluid) in a single closed loop formed through an electrically-driven compressor and two heat exchangers, which are usually termed a condenser and an evaporator, and other ancillary components. Heat pumps may be operated in single mode either to cool or heat the interior of a building structure, but more commonly, can be reversed to cool the interior in summer and heat it in winter. Systems based on similar principles are also used in other heat transfer applications.

These systems rely on the intrinsic thermodynamic properties of the working fluid, particularly on the fluid's ability to absorb and reject a large amount of heat energy quickly, in accordance with its critical behavior as a function of the temperature and pressure to which it is subjected. In most systems, the absorption and rejection of heat is heightened by using a working fluid that is repetitively transformed between the liquid and vapor states as it traverses the heat pump loop. Each transformation is accompanied by the absorption or release of a relatively large amount of heat energy, termed the latent heat of evaporation. This is accomplished by configuring and operating the system so that the requisite temperature and pressure are found at crucial locations in the flow path.

A typical prior art, vapor compression heat pump system is shown generally at 2 in FIG. 1. The system comprises a compressor 4, first heat exchanger 14 and second heat exchanger 16, and a metering valve 6. Tubing connects these components to form a single loop through which a working fluid circulates.

The term "heat exchanger" is used herein in its conventional sense to denote generally a structure by which heat energy is transferred from one fluid to another fluid, with the two fluids being kept separate. Each of the fluids can be either a liquid, a gas, or a combination thereof. Ordinarily, a heat exchanger has a conduit that is part of a closed loop through which the first fluid flows. The exchanger may further comprise one or more heat transfer structural elements bonded to the conduit and disposed so that they increase the area in contact with the second fluid. The heat transfer structural elements are thus in thermal communication with the first fluid so that heat can be transferred while keeping the two fluids separate, i.e., without any fluidic communication between them. Numerous forms of heat exchangers are known in the art.

Conventional heat pump systems use a variety of known types of heat exchangers for the condenser and evaporator. For illustrative purposes, the heat exchangers 14, 16 in FIG. 1 are of the tube and fin type. Each comprises a central metal tube 18 and a plurality of thin metal fins 19, each having an aperture through which the central tube 18 passes. Each fin 19 is soldered, welded, or otherwise affixed to central tube 18 to provide mechanical integrity and thermal contact. The fins 19 are thus exposed to an ambient atmosphere in which the respective heat exchanger is situated, and function as heat transfer thermal elements, as discussed above. The working fluid (either vapor or liquid) passes through the central tube, so that thermal energy is exchanged through the fins between the working fluid and the ambient atmosphere, which functions as the second fluid. The direction of heat flow is determined by the relative temperature of the two fluids. The material, number, and configuration of fins 19 may be selected in accordance with the fluids used and operational requirements. Most commonly, a large number of fins are constructed of thin sheets of metal with good thermal conductivity to provide a large surface area from which heat is transferred. The rate of heat transfer may be enhanced further by using a fan to increase the airflow across the fins. Alternatively, central tube 18 might have a meander pattern that passes multiple times through apertures in fins 19. The heat exchanger might also have a plurality of flow tubes, each being connected to an inlet manifold and an outlet manifold, through which the working fluid is respectively received and discharged.

For cooling the interior air of a building, first heat exchanger 14 is situated outside the building and functions as the condenser, while second heat exchanger 16 is situated inside and functions as the evaporator. Refrigerant enters compressor 4 at inlet 7 and is 100% vapor at low temperature and pressure. The compressor 4 compresses the refrigerant, increasing both its temperature and its pressure. Refrigerant flows from outlet 8 to the first heat exchanger 14, where it condenses, liberating heat that is rejected to the outside air. The refrigerant continues to metering valve 6, which controls flow, so that refrigerant enters into the second heat exchanger 16 at low temperature and pressure. Cooling of the building is effected by transferring interior heat through second heat exchanger 16 into the refrigerant, causing it to evaporate or boil, reaching saturation. The single loop is completed as refrigerant vapor exits the second heat exchanger 16 and returns to inlet 7 of compressor 4.

Heat pump system 2 can be converted to heat a building interior by suitable valving that reverses the refrigerant flow and the functioning of the heat exchangers so that first heat exchanger 14 becomes the evaporator and second heat exchanger 16 becomes the condenser. In both configurations, heat transfer is enhanced and speeded by the evaporation and condensation of the refrigerant, which respectively releases and absorbs a relatively large amount of heat energy as the latent heat of vaporization.

As noted above, conventional heat pump systems further rely on vaporizing their working fluid during the operating cycle. At a given ambient pressure, any chemical substance feasibly used as a working fluid reversibly transforms between liquid and vapor (or gas) at a temperature defined as the phase boundary temperature or boiling point. The transition is accompanied by the release or rejection of heat energy on boiling or the absorption of heat on condensation back to the liquid, the amount per unit mass being termed the specific latent heat of vaporization. The boiling point varies with the ambient pressure, with the locus of points on a phase diagram showing the variation of this temperature with pressure being termed the phase boundary curve. Liquid at a temperature below the phase boundary temperature for a given pressure is said to be subcooled. At the boundary temperature, the liquid is said to be saturated, since there is an equilibrium coexistence of vapor and liquid in a closed container.

Heat pump system 2 is designed to approximate the thermodynamic Carnot refrigeration cycle as closely as possible to obtain the highest practically attainable efficiency. The Carnot refrigeration cycle is commonly referred to as a "reversed heat engine" and employs the same underlying principle of operation as the theoretical Carnot cycle. In simplest terms, the theoretical Carnot cycle involves a heat engine that transfers heat between a hot heat reservoir at temperature $T_H$ and a cold reservoir at temperature $T_C$ using a working fluid. In a heat pump system configured for cooling, the reservoirs are the atmospheres inside and outside the building. In the first step of the Carnot cycle, the fluid is isolated from the cold reservoir but in thermal contact with the hot reservoir, so that heat is transferred from the hot reservoir to the fluid. The fluid isothermally expands, drops in pressure, and does mechanical work on its surroundings. The second step is adiabatic, with the fluid being isolated from both reservoirs, so it does not absorb or reject any heat. It cools and expands without change of entropy, delivering further work to the surroundings. Third, the fluid is placed in contact with the cold reservoir and compressed. Energy as heat and entropy is rejected isothermally into the cold reservoir. Finally, the fluid is again thermally isolated from the hot and cold reservoirs while it continues to be compressed adiabatically and without a change in entropy. The Carnot cycle is a theoretical construct, in which: no energy is lost to friction or other mechanical dissipation, the thermodynamic processes in all four stages are assumed reversible, and the respective temperature differences between (a) the hot reservoir and the hot fluid and (b) the cold reservoir and the cold fluid are assumed infinitesimal. It is understood that the Carnot cycle represents an upper bound on the efficiency of any classical process in accordance with the Second Law of Thermodynamics.

Heat pump systems can be used for other heating or cooling purposes, e.g., in residences and commercial buildings and in industrial processes. For example, hot water could be provided by using a fluid-to-water heat exchanger as the condenser so that incoming water from the mains is heated to provide hot water for typical domestic use in bathing, washing, etc.

In recent years, numerous researchers have endeavored to improve vapor compression heat pump systems, to increase their energy efficiency and to streamline their manufacture. Despite attempts to modify conventional heat pumps to allow them to operate efficiently over a wider range of outside ambient temperatures, both equipment structure and operational characteristics, and the thermodynamic properties of possible working fluids remain limiting factors.

Additional challenges have come from environmental requirements. A number of refrigerants that have attractive properties for the heat pump itself have been discovered to be environmentally detrimental, in that they are believed to cause ozone depletion and to affect global warming. Both national and international regulations have thus been imposed that limit the use of certain refrigerants or ban them entirely. Substitutes have been developed, but in some instances, existing HVAC equipment does not perform as efficiently or reliably with them. In others, existing equipment is incapable of running with the new refrigerants. Some of the proposed substitutes are also undesirable because of toxicity or flammability.

Accordingly, there remains a significant need for systems that exhibit improved operational efficiency and can accommodate different and approved refrigerants that are more environmentally friendly.

SUMMARY OF THE INVENTION

One aspect of the present disclosure provides a heat transfer apparatus, comprising:

a) a compressor-expander having a cylindrical bore and a piston movable within the bore along a central axis thereof, the piston hermetically separating the bore into first and second volume portions that are fluidically connected through an intervening check valve that is configured to permit the transfer of a working fluid from the first volume portion to the second volume portion; and wherein the cylindrical bore has: a liquid compressor inlet and a liquid compressor outlet situated respectively to receive working fluid into, and discharge working fluid out of, the first volume portion; and a vapor compressor outlet situated to discharge working fluid from the second volume portion;

b) a prime mover capable of being connected to an external power source and configured to drive the piston in reciprocating motion along the central axis;

c) a reservoir having a vapor return inlet, a liquid return inlet, and a liquid reservoir outlet that is in fluidic communication with the liquid compressor inlet through an intervening supply valve;

d) a vapor return providing fluidic communication between the vapor compressor outlet and the vapor return inlet controllable by an intervening regulating valve; and e) a liquid return providing fluidic communication between the compressor-expander and the reservoir controllable by an intervening return valve.

Another aspect provides a method for transferring heat energy from a heat source to a heat sink, comprising: providing a reservoir containing subcooled working fluid, a compressor-expander having a total volume variably apportioned between first and second volume portions, a vapor return, and a liquid return, wherein the first volume portion is fluidically connected to the reservoir through the vapor return and the second volume portion is fluidically connected to the reservoir through the liquid return, and carrying out repetitively a cycle comprising the steps of:

a) transferring a preselected amount of the subcooled working fluid from the reservoir to the first volume portion;

b) expanding the first volume portion to reduce adiabatically the pressure therein, whereby the working fluid is cooled and at least a portion thereof is converted to vapor;

c) contracting the second volume portion to increase adiabatically the pressure therein above a target pressure set point, whereby any working fluid therein is heated, and thereafter releasing the pressurized fluid to pass through the vapor return to the reservoir, whereby heat is rejected from the working fluid through the vapor return to the heat sink and pressure in the second volume portion is reduced below the target pressure set point;

d) thereafter, expanding the second volume portion and contracting the first volume portion;

e) equalizing the pressures of the working fluid between the first and second volume portions by fluidically connecting the first and second volume portions, so that the temperature of working fluid remaining in the second volume portion is increased; and f) thereafter, emptying the first volume portion by isobarically transferring the working fluid remaining therein through the liquid return to the reservoir, while removing ambient heat into the working fluid in the liquid return.

In certain embodiments, the present heat transfer apparatus and method of operation afford significant advantages of performance over conventional, vapor compression heat pump systems, both in configurations appointed solely for heating or cooling and in those capable of being reversed to provide both modes of operation. In suitable configurations, the systems may save electrical power required for operation while providing increased efficiency ratings as denoted by industry-recognized metrics. With the capability for adaptive operation, they are capable of minimizing temperature lift to further improve efficiency. Systems may also be designed to operate over a wider ambient temperature range compared to existing systems, which are often limited for heating in cold winter climates. They may be configured with a wide range of working fluids chosen for reasons of environmental effects, toxicity, and flammability.

BRIEF DESCRIPTION OF THE DRAWINGS

The present invention will be more fully understood, and further aspects and advantages will become apparent when reference is had to the following detailed description of certain preferred embodiments of the invention and the accompanying drawings, wherein like reference numerals denote similar elements throughout the several views and in which.

DETAILED DESCRIPTION

Various aspects of the present disclosure relate to the construction and use of a heat transfer apparatus capable of transferring heat energy from a heat source to a heat sink.

Heat Transfer Apparatus

Figure 2:
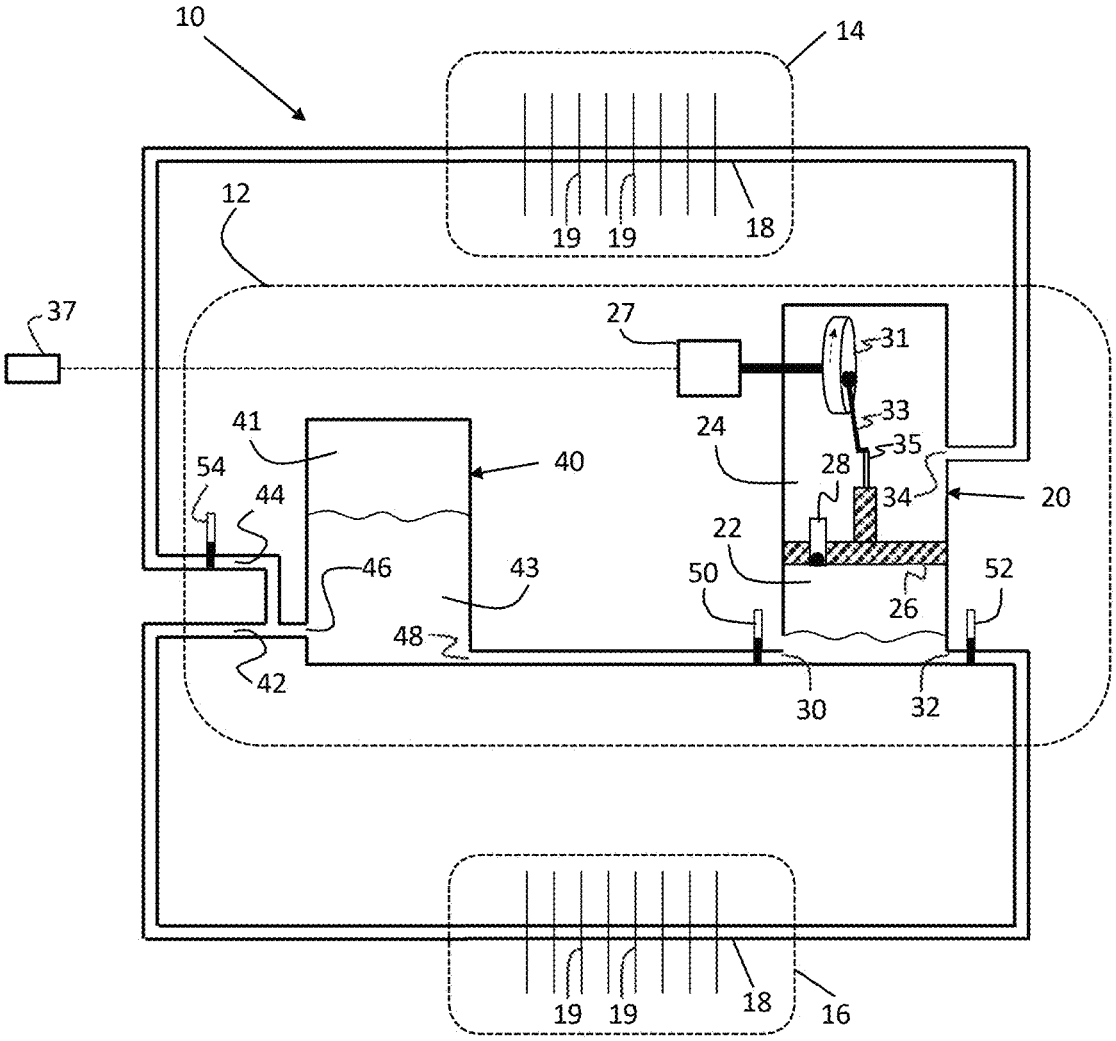
FIG. 2 depicts schematically and in cross-sectional view an implementation of a heat transfer apparatus of the present disclosure.

An implementation of the heat transfer apparatus of the present disclosure is depicted generally at 10 in FIG. 2. It comprises vapor expansion heat pump 12, vapor heat exchanger 14, and liquid heat exchanger 16, each being denoted generally by dashed rectangles. The heat exchangers 14, 16 and heat pump 12 are in fluidic communication through conduits such as tubes of metal or other suitable material. The apparatus employs a working fluid that is compressed and expanded and circulated through the conduits, as further described below. Preferably, the working fluid has thermodynamic characteristics such that it can reversibly undergo transformation from liquid to vapor at temperatures and pressures that are compatible with desirable operating characteristics of the present system. Some suitable fluid substances, including many single-phase substances, undergo a true thermodynamic phase change at specified temperatures and pressures, with an associated and relatively large latent heat of vaporization. However, other azeotropic and zeotropic agents that do not have uniquely-defined phase transition conditions are also usable in suitably configured systems in accordance with the present disclosure. Such materials also gain and release comparably large amounts of heat associated with evaporation and condensation, but over a small range of temperatures and pressures, rather than at specific, well-defined combinations of pressure and temperature. They also add additional design flexibility, permitting the present apparatus to be employed over a wider range of ambient temperature conditions.

Heat pump 12 comprises compressor-expander 20 and reservoir 40. In the implementation depicted, compressor-expander 20 has an internal cavity that includes a generally cylindrical bore. Piston 26 is adapted to be moved within the bore of that cavity in a cyclic, reciprocating motion upward and downward along the central bore axis. The drive mechanism for piston 26 includes a prime mover. In an embodiment, the prime mover is a rotating electric machine 27, which drives a rotary crank 31 and a connecting rod 33 to convert rotary motion to reciprocating linear motion. The crank 31 is attached to a rotating shaft of the machine and thus driven directly as depicted in FIG. 2; alternatively, crank 31 can be driven indirectly through a belt, chain, or gear mechanism. The wall of compressor-expander 20 includes an aperture with a suitable hermetic, rotary seal through which the rotating shaft passes. Connecting rod 33 articulates at one end with crank 31 and at the other either directly with piston 26 or, as shown in FIG. 2, with an actuating shaft 35 attached to the piston, possibly as a unitary structure. Rotation of crank 31 as shown by the dashed arrow thus causes actuating shaft 35 to drive piston 26 in a linear, reciprocating motion along the cylinder axis. Alternatively, crank 31 and connecting rod 33 might be situated outside compressor-expander, with actuating shaft 35 slidably passing through an aperture in a top wall of the compressor-expander with a suitable linear shaft seal. In another alternative, the entire drive system, including machine 27, could be housed within the compressor-expander 20 to eliminate the need for any moving shaft to penetrate.

The electric machine is capable of being energized by an external power source 37, such as the electrical grid or a battery (not shown). The machine configuration and design preferably render it capable of operating either as a motor or as a generator, i.e., a machine capable of either: (a) converting electrical energy from source 37 to mechanical work to rotate the crank or (b) converting mechanical energy to electrical energy returnable to source 37 if the piston is driven by action of the working fluid. For example, a permanent magnet-type DC motor is one such device, and source 37 might be energized from the electrical grid, as well as including a battery or other electrical storage device to store energy returned during part of the operation when the machine is converting mechanical power back to electrical. In some implementations, a flywheel (not shown) is associated with the rotating crank to reduce vibration, better stabilize the rotating motion, and mechanically store energy during portions of each cycle. Preferably, the flywheel is directly attached to a shaft of the rotating crank or is otherwise formed integrally therewith.

The total volume of the cylindrical bore, apart from piston 26 and any enclosed drive system components, is apportioned between first volume portion 22 below piston 26, and second volume portion 24 above. The volume of the cylindrical bore is thus exchanged between portions 22 and 24 as piston 26 moves up and down. To minimize or preferably eliminate any incidental or undesired flow of working fluid between volume portions 22 and 24, piston 26 is either dimensioned to fit the cylinder bore very closely or suitable seals (not shown) are provided. Preferably, the cylinder and piston 26 are configured so that the volume of first volume portion 22 is reduced as much as possible when piston 26 is at its downmost extremum, to minimize retention of the working fluid. In various embodiments, the opposing bottom surfaces of piston 26 and the cylinder may be either planar or have mating domed concave and convex shapes, respectively. A check valve 28 permits controllable transfer of a vapor portion of the working fluid from first volume portion 22 to second volume portion 24. Depending on how the prime mover and piston drive are arranged, the minimum volume of portion 24 (reached when piston 26 is at its topmost extremum) will ordinarily be larger than the minimum in portion 22. Compressor-expander 20 has a liquid compressor inlet 30 and a liquid compressor outlet 32 situated respectively to receive working fluid into, and discharge working fluid out of, first volume portion 22. Compressor-expander 20 further comprises a vapor compressor outlet 34 situated to discharge working fluid out of second volume portion 24.

Reservoir 40 comprises a volume configured to receive working fluid discharged from heat exchangers 14, 16. Reservoir 40 further comprises a vapor return inlet 44, a liquid return inlet 42, and a liquid reservoir outlet 48. As depicted, inlets 42 and 44 are fluidically connected external to the reservoir, joining to form a single reservoir inlet 46 into the volume of the reservoir. Alternatively, inlets 42 and 44 might be situated so working fluid from each can enter the volume directly, thus eliminating the need for reservoir inlet 46. Reservoir 40 is sized to contain an adequate amount of working fluid throughout the operation of the apparatus, including during each portion of each operating cycle.

Although not required, the volume of reservoir 40 is typically much larger than the volume of compressor-expander 20, even including the volume of the heat exchangers and associated connecting piping. In some embodiments, the volume ratio is at least 2:1, 5:1, 10:1, 20:1, 30:1, or 50:1. Choice of a large volume, so that the reservoir contains much more fluid than is circulated through the two loops during each cycle, minimizes thermal changes within the reservoir as the fluid is returned at the end of each cycle. A large ratio is also believed to minimize the number of cycles required after start-up to reach steady state.

Compressor-expander 20 and reservoir 40 are fluidically connected such that two loops are provided for separately circulating working fluid in two streams. More specifically, a vapor loop is completed by a vapor return that that provides fluidic communication between vapor compressor outlet 34 and vapor return inlet 44, with flow controllable by regulating valve 54. In some embodiments, the vapor return further comprises a vapor heat exchanger 14 through which working fluid flows. In FIG. 2, vapor compressor outlet 34 is connected to the inlet of vapor heat exchanger 14 and vapor return inlet 44 is connected to the outlet of vapor heat exchanger 14 through regulating valve 54. A liquid loop is completed by a liquid return that provides fluidic communication between liquid compressor outlet 32 and liquid return inlet 42. In the implementation of FIG. 2, the liquid return comprises liquid heat exchanger 16, whose inlet and outlet are respectively connected to liquid compressor outlet 32 and liquid return inlet 42. Control of fluid flow in the liquid return is provided by return valve 52. FIG. 2 shows return valve 52 situated at liquid compressor outlet 32, but it might be placed elsewhere in the return, either ahead of liquid heat exchanger 16 or on the reservoir side. When the heat transfer system configuration and operating parameters are optimally set, the fluid exiting the two return loops and entering the reservoir at the respective liquid and vapor return inlets is predominantly liquid, but it will be understood that there may be some residual vapor in each stream. A skilled artisan will further recognize that the use of terms "liquid" and "vapor" in denominating the two loops and various inlets and outlets of components of the present system, such as compressor-expander 20 and reservoir 40, is not intended to mean that exclusively liquid or vapor passes therethrough, but rather to more clearly and descriptively delineate the two loops that carry different streams of the working fluid flow. In the implementation of FIG. 2, a portion of the liquid and vapor loops is shared as a fluidic connection from liquid reservoir outlet 48 to compressor inlet 30.

In the practice of the present invention, any suitable alternative may be used for each of the heat exchangers. The particular type, configuration, and sizing for each may be selected dependent on the operational requirements. In the implementation depicted in FIG. 2, the heat exchangers 14, 16 are of the tube and fin type, as described above. This type is conveniently used when heat energy is to be exchanged with the ambient atmosphere. A tube in tube heat exchanger may be used if a liquid, such as water, is to be heated or cooled.

The heat transfer apparatus of the present invention operates by the circulation of working fluid through two loops. The fluid flows are controlled by an appropriate valving arrangement. In the implementation of FIG. 2, the flows are controlled by check valve 28 between first and second volume portions 22, 24 of compressor-expander 20; liquid inlet valve 50 between liquid reservoir outlet 48 and liquid compressor inlet 30; liquid outlet valve 52 between liquid compressor outlet 32 and liquid heat exchanger 16; and vapor inlet regulating valve 54 between vapor heat exchanger 14 and vapor return inlet 44. In FIG. 2, all of these valves are shown in the closed position, but during operation they are opened and closed in a suitable sequence based on the reciprocating motion of piston 26.

Furthermore, in the configuration of FIG. 2, the various valves are shown as being disposed in specific positions relative to other system components. For example, check valve 28 is shown as being integral with piston 26, valves 50 and 52 are located near the inlet 30 and outlet 32 of the first volume portion 22 of compressor-expander 20, and regulating valve 54 is at inlet 44 of reservoir 40. A skilled person will recognize that each of these valves governs the transfer of working fluid from one part of system 10 to another so that the same functions can be accomplished with one or more of the valves disposed in alternative positions along the relevant fluidic path. For example, check valve 28 could alternatively be disposed in a separate fluidic connection, such as a bypass tube, that permits working fluid to flow from first volume portion 22 to second volume portion 24 when required. Similarly, valve 52 could be located downstream of heat exchanger 16. However, the locations shown in FIG. 2 are presently believed to be preferred. Other forms of construction might also be possible, such as embodiments in which check valve 28 is unitarily incorporated in piston 26. Valves 50, 52, and 54 might also include check valve protection to ensure that only the requisite unidirectional working fluid flow is possible.

In some implementations of the present apparatus, any one or more of valves 28, 50, 52, and 54 may be actuated electrically. Such valves are preferably operated by a suitably connected electronic control means, such as an electrical or electronic controller, a microprocessor, or a general-purpose computer, that coordinates the valve sequencing with the motion of piston 26. Ordinarily, such a control means will control the one or more valves based on input from sensors responsive to various conditions, such as ambient temperature and pressure (inside and/or outside) and operating conditions at one or more points within the components of the system. For example, and without limitation, the control means may respond to current and voltage in the prime mover and temperatures and pressures of the working fluid. The control means might also rely on input from a sensor that senses the position of the piston, either directly or indirectly, and using electromechanical, electro-optical, electromagnetic, or other suitable sensing mechanisms. This sensor could sense the position of the piston directly. Alternatively, and especially in implementations wherein the piston is driven by a crank arrangement, the position could be inferred indirectly, e.g., from the angular position of the crank as determined using an angular encoder attached to the crank. In still another alternative, the rotation rate of the crank (and thus, the duration of each piston cycle) might be ascertained using a crank position sensor adapted to signal each time the crank reaches a definite, preselected angular position within its rotation, such as the point corresponding to top or bottom dead center. Intermediate positions of the piston could then be inferred, corresponding to a fraction of the total duration, measured relative to successive triggering of the crank position sensor. In still other crank-based implementations, the valves are actuated by a cam arrangement that mechanically actuates one or more of the valves at the requisite point in the reciprocating motion of piston 26.

The sequencing of the valves, in turn, regulates the thermodynamic cycle of the working fluid in each loop. For example, the duration of valve 50 being opened determines how much fluid is introduced into compressor-expander 20, and the opening of valve 54 determines the pressure attained in the vapor loop. In some preferred embodiments, the sequencing of the valves is done adaptively, meaning that the timing and/or exact pressures at which one or more of the valves opens and closes, may be adjusted by the electronic controller in response to any of ambient internal or external conditions, the critical behavior of the particular working fluid used, or a desired mode of operation, such as the rate at which a desired conditioned air temperature is to be obtained after startup or a limitation on the rate of electrical energy consumption is needed.

Heat Transfer Method

In another aspect, the present disclosure provides a method for transferring heat energy from a heat source to a heat sink.

A skilled person will recognize that the operation of a practical heat engine is typically described by the thermodynamic processes that occur repetitively during steady state operation. That is, immediately after startup, a number of cycles have to be completed before the operation can be described as having reached "steady state." At that point, characteristics of the system and its working fluid, such as temperatures and pressures at particular locations in the apparatus, vary only slightly between the values attained at comparable instants within each subsequent cycle. A skilled person will further recognize that in the practice of the present method, within each cycle, one or more of the constituent steps may be carried out during time intervals that overlap or that some of the steps may be carried out simultaneously, depending on the particulars of the equipment being used. For example, in implementations that employ a compressor-expander that includes a reciprocating piston that delimits the first and second volume portions, expanding the volume of either portion is necessarily concomitant with the contraction of the other portion on the opposite side of the piston.

Thermodynamic processes that occur during the operation of a heat engine are often characterized using terms such as "adiabatic," "isothermal," "isobaric," and "reversible." A skilled artisan will recognize that these terms are idealized in that no practical process ever fully attains the conditions implied by such terms. The artisan will thus understand that processes described herein by these and similar thermodynamic terms will ordinarily deviate slightly but insubstantially from the idealized definition.

A representative implementation of the present method of operation may be accomplished using the heat transfer apparatus illustrated in FIG. 2. The method entails the repetition of an operating cycle that comprises steps described schematically in FIGS. 3A-3F. During each cycle, piston 26 reciprocates once within the bore of compressor-expander 20. Transition points occur at the extrema of the reciprocating motion of piston 26 and at certain intermediate points; at each point, the valves are sequenced, as depicted schematically in FIGS. 3A-3F and further described below. Each of these figures shows the heat pump 12 of FIG. 2 generally at one of the transition points, and more particularly, the schematic location of piston 26 at that particular point and the state of the valves 28, 50, 52, and 54 in the interval within the cycle between that point and the subsequent transition point. (For clarity of illustration, heat exchangers 14, 16, and certain elements of compressor-expander 20 and reservoir 40 and their fluidic connections are omitted in FIGS. 3A-3F.) The cycle depicted by the sequence of FIGS. 3A to 3F is repeated while the apparatus is in operation.

Figure 3A:
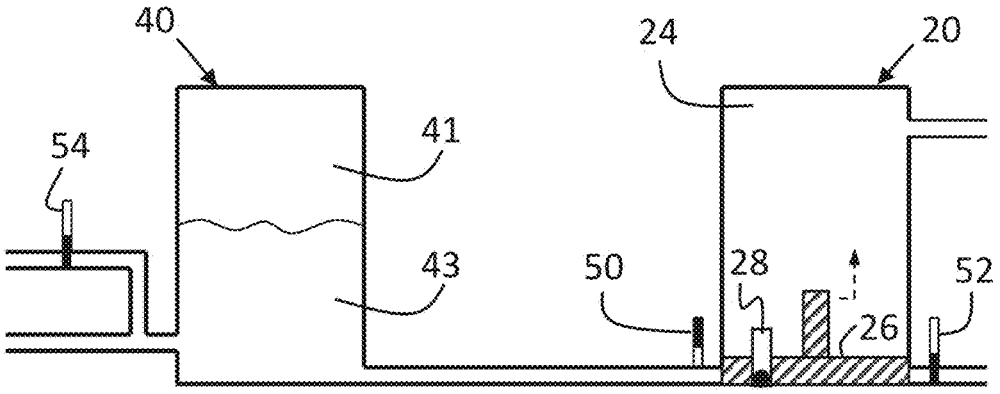
FIGS. 3A-3F depict schematically various stages in an operating cycle of an implementation of the present heat transfer apparatus system, specifically showing the coordination of piston movement and valve sequencing through the stages of the operating cycle.
Figure 3B:
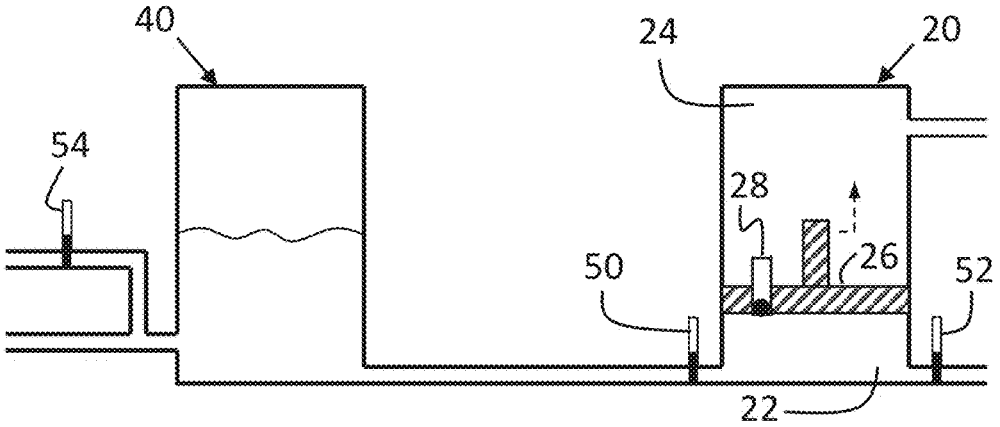
Figure 3C:
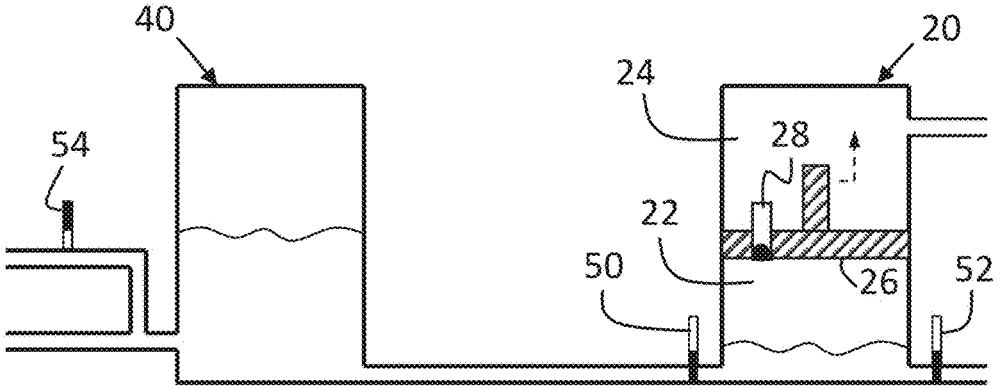
Figure 3D:
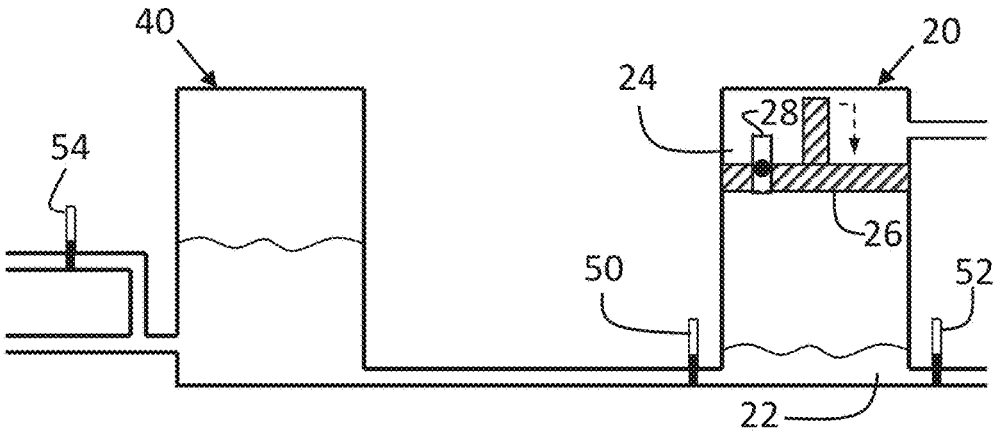
Figure 3E:
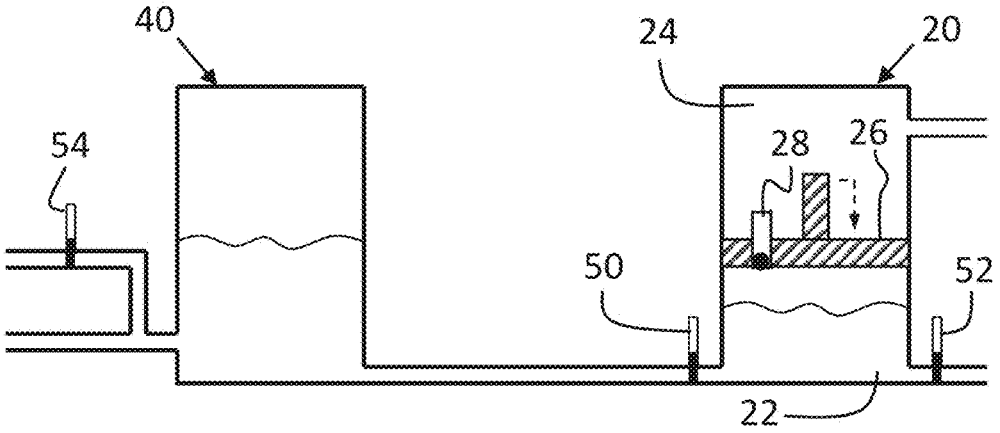
Figure 3F:
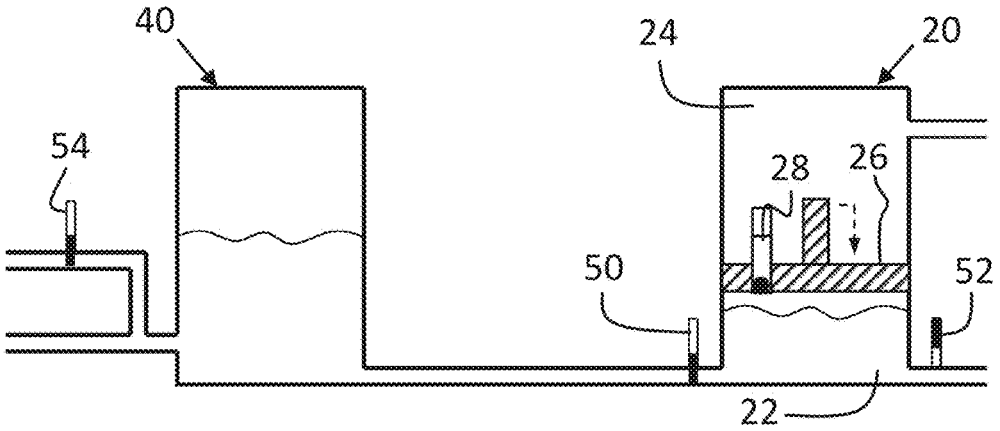

The operational sequence is thus set forth, beginning at transition point A seen in FIG. 3A. Piston 26 is located at the bottom extremum of its reciprocating motion (sometimes termed "bottom dead center," or "BDC"). Thus, the second volume, portion 24, is at its maximum, and the first volume portion 22 is at its minimum. Reservoir 40 contains subcooled liquid working fluid 43, as indicated by the wavy surface line delimiting working fluid 43 from headspace 41 above. Preferably, headspace 41 is pressurized, e.g. by an inert gas, to overpressure the working fluid, and thereby to assure steady flow of working fluid as required during the cycle, to minimize cavitation in the liquid fluid, and/or to establish the temperature of the subcooled working fluid in reservoir 40. Valves 28, 52, and 54 are closed and valve 50 is opened. Thereafter, the prime mover causes piston 26 to begin to move upward, as indicated by the upwardly directed dotted arrow. Subcooled liquid working fluid at high pressure is thus transferred adiabatically from reservoir 40 into the first volume portion 22, whose volume increases commensurately. Vapor in second volume portion 24 is at high pressure.

Transition point B (FIG. 3B) occurs when a preselected amount of working fluid has been metered into first volume portion 22. In some implementations, the amount of fluid is adjusted, based on the ambient temperatures at the heat exchangers and the desired amount of heating or cooling to be accomplished. To attain good efficiency, a larger amount of fluid is ordinarily required when the system is operating in a cooling mode than a heating mode, but the amount should not exceed half the cylinder volume during steady-state operation. Valve 50 is then closed and piston 26 continues to move upward. The volume in first volume portion 22 increases, reducing the pressure therein. The process is adiabatic, with at least some of the working fluid being vaporized, so that both it and any remaining liquid are cooled. The volume of the vaporized working fluid in second volume portion 24 (together with the volume within heat exchanger 14 and associating piping) decreases, thereby increasing its pressure and temperature. The change in internal energy, as this part of the working fluid becomes subcooled, thus stores all of the energy supplied from the prime mover.

At transition point C (FIG. 3C), the vapor in second volume portion 24 reaches a target pressure. Regulating valve 54 impedes the flow through the vapor loop, allowing pressure to increase so that heat can be released. In some embodiments, regulating valve 54 is of a type that is fully closed until a specific target pressure is reached. The target pressure may be a single fixed point, but preferably regulating valve 54 can be electronically controlled to allow the target pressure to be adaptively adjusted during operation. In such implementations, regulating valve 54 opens when pressure in second portion 24 and the vapor return loop exceeds the pressure in reservoir 40 by the target amount. The opening allows this working fluid to flow through heat exchanger 14 and back into reservoir 40. The target pressure set point of valve 54 is preferably selected so that the condensation temperature of the working fluid is above the ambient temperature of heat exchanger 14, to ensure that heat energy is transferred and benefit of the latent heat associated with the condensation is obtained. Substantially all the heat thus rejected is transferred by heat exchanger 14 to the atmosphere surrounding it. The configuration of the vapor return loop and the operating conditions of temperatures and pressures are preferably arranged so that substantially all of the initial vapor in portion 24 condenses to liquid that is returned to reservoir 40. Some portion of the working fluid in first volume portion 22 may remain as non-vaporized liquid, as indicated by the wavy surface line. Piston 26 continues its upward movement. Without being bound by any theory, it is believed that having a relatively large total volume in the combination of the top portion of compressor-expander 20, heat exchanger 16, and the associated connecting tubing, promotes the efficiency of the present system, by increasing the volume of the fluid in which energy is stored in the fluid during the part of the cycle between transition points B and C.

Transition point D (FIG. 3D) occurs when piston 26 reaches its top extremum (sometimes termed "top dead center," or "TDC") and begins to move downward. Regulating valve 54 is closed. Initially, the energy stored within the fluid of second volume portion 24 is converted to mechanical work that acts to urge the downward motion of piston 26. Ordinarily, that work is sufficient that no energy needs to be supplied from the prime mover for this motion; instead, the prime mover becomes a source generating electrical energy that can be returned to the source, and preferably stored in an electrical storage device such as a battery. The amount of converted energy diminishes as this point of the cycle continues. At some point, the pressure of the vaporized working fluid in first volume portion 22 exceeds that in second volume portion 24, causing check valve 28 to open and allow flow back into portion 24.

During the portion of the cycle after transition point D, the compression of fluid in first volume portion 22 stores some amount of energy within the fluid (thus heating it) and transfers it back into second volume portion 22 through check valve 28 in preparation for the next cycle.

The downward motion of piston 26 continues to transition point E (FIG. 3E), marked by equalization of pressure between first and second volume portions 22, 24, whereupon check valve 28 closes.

Soon thereafter, transition point F (FIG. 3F) is reached with at most a slight fraction of first volume portion 22 remaining as vapor. Valve 52 is opened to permit the remaining working fluid in first volume portion 22 to flow through liquid heat exchanger 16 and back into reservoir 40. The downward motion of piston 26 continues until transition point A is reached with first volume portion 22 having been emptied of as much of the remaining working fluid as possible. Ambient heat is removed from the surroundings of the system into the working fluid in the liquid return. This extraction is enhanced in embodiments that include a heat exchanger in the liquid return loop. Thereafter, the cycle repeats indefinitely.

The present method and apparatus can be practiced with a wide variety of working fluids known in the heating and refrigerating arts. The choice of fluid is made to best satisfy the required performance requirements for a desired application and the ambient conditions expected to be encountered in a given locale, while being consistent with other regulatory and marketing requirements.

The apparatus and method described hereinabove with reference to FIGS. 2 and 3A-3F is intended to operate in a single mode only, wherein the atmosphere surrounding heat exchanger 14 is heated and the atmosphere surrounding heat exchanger 16 is cooled. Such a system might be used for heating the interior of any building structure by situating heat exchangers 14, 16 in the interior and exterior of the structure, respectively. A similar system could be used to cool the building interior by disposing the exchangers in opposite positions. The specific operational parameters controlling the pressure levels of the working fluid and the timing of the sequencing of the valves need to be matched to the interior and exterior air temperatures at which the system is expected to operate.

Figure 1:
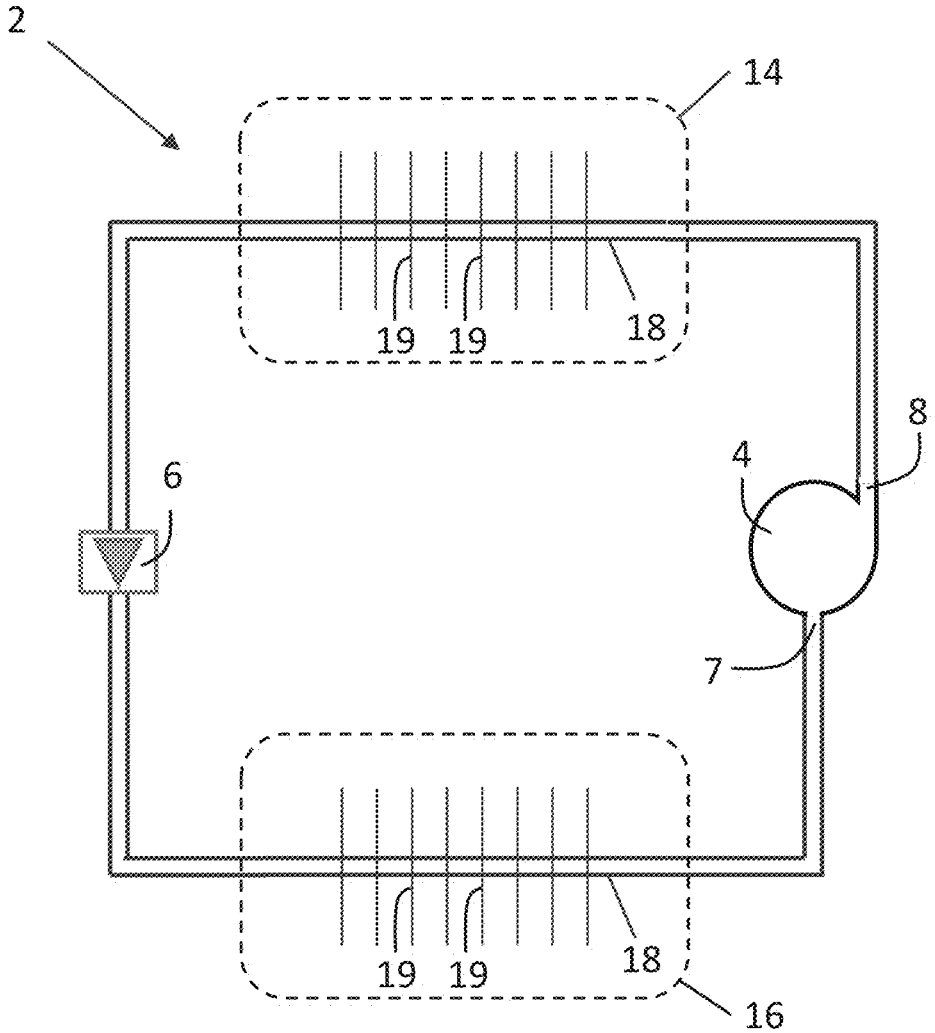
FIG. 1 (Prior Art)
FIG. 1 depicts schematically a prior art vapor compression heat pump system.
Figure 4A:
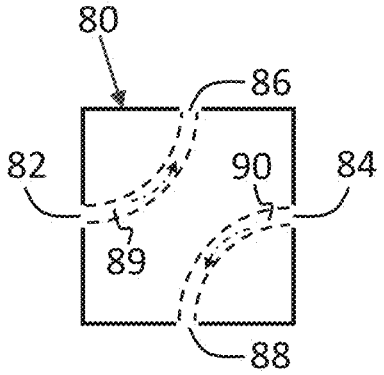
FIG. 4A depicts schematically and in cross-sectional view a reversing valve used with the present heat transfer apparatus, with the internal passages of the valve in one configuration.
Figure 4B:
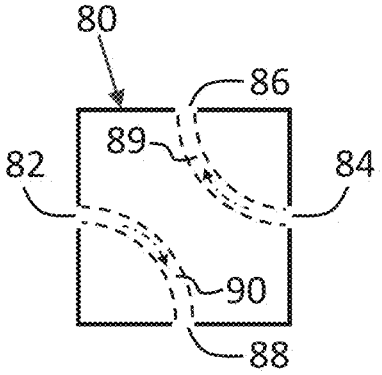
FIG. 4B depicts schematically the same reversing valve as shown in FIG. 4A, but with its internal passages set to direct fluid flow in an opposite direction.

A comparable apparatus can also be used as a heat pump intended to be used for both heating and cooling a building structure, e.g. in different seasons of the year. Implementations thus appointed may use reversing valves, such as the reversing valve depicted generally at 80 in FIGS. 4A and 4B. Valve 80 has two inlet ports 82 and 84 and two outlet ports 86 and 88. It includes internal passages 89, 90 that provide fluidic connection of the ports. The passages are situated in an internal structure that can be rotated by mechanical or electrical actuation. FIG. 4A shows valve 80 in one position, such that internal passage 89 connects inlet port 82 to outlet port 86 to allow fluid to flow in the direction indicated by a broken arrow. Similarly internal passage 90 connects inlet port 84 to outlet port 88, with fluid flow again shown. After rotation of the internal structure by 90°, the connections are reversed, with internal passage 89 now connecting inlet port 82 to outlet port 88 and passage 90 now connecting inlet port 84 to outlet port 86, FIG. 4B.

Figure 5:
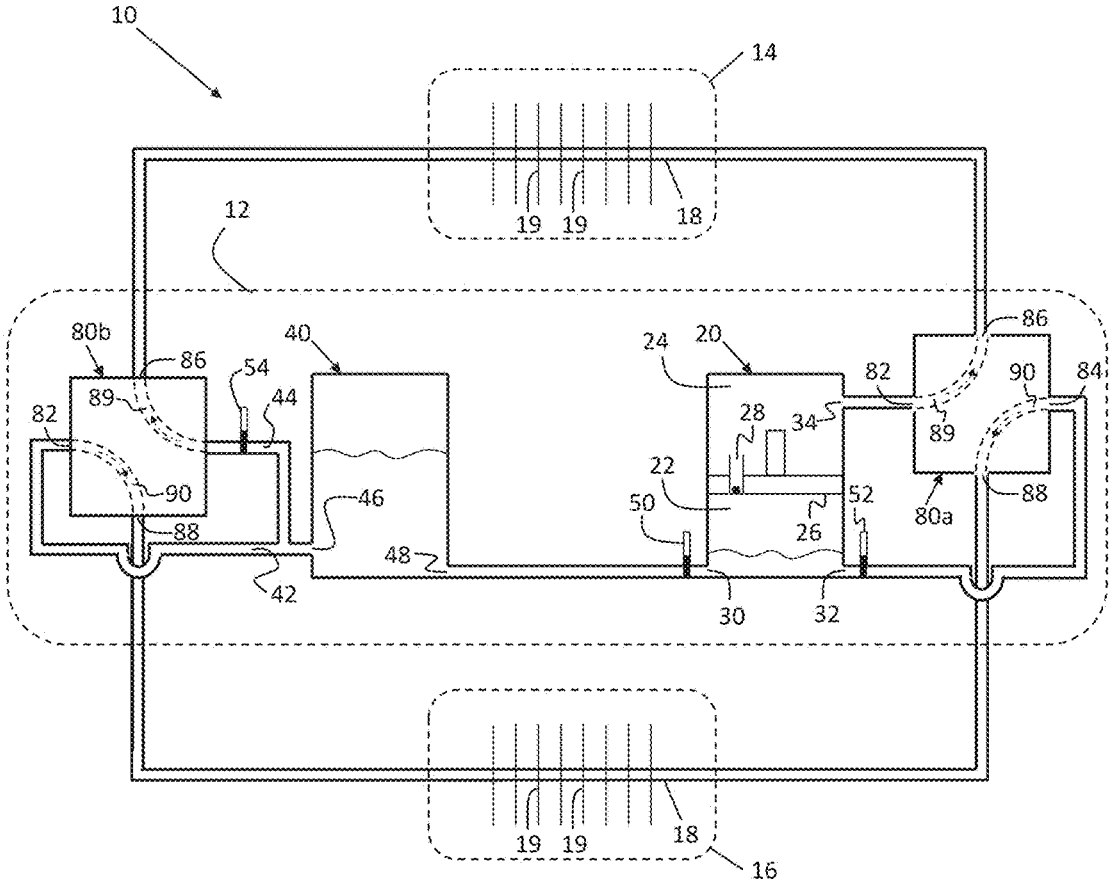
FIG. 5 depicts schematically another implementation of the present heat transfer apparatus, with the capability of being reversed to operate alternatively in both heating and cooling modes.

FIG. 5 shows a heat pump configuration that includes two such reversing valves 80*a* and 80*b*. Valve 80*a* reverses connections to outlet ports 32, 34 of compressor-expander 20, while valve 80*b* reverses connections to the inlet ports 42, 44 of reservoir 40. The heat pump is depicted on FIG. 5 as set for cooling a structure, with vapor heat exchanger 14 outside and liquid heat exchanger 16 inside, and valve 80*a* in the setting of FIG. 4A and valve 80*b* in the setting of FIG. 4B. The heat pump configuration can be changed to heating by reversing the setting of valves 80*a* and 80*b*, so that the working fluid flows reverse and the heat exchangers reverse function.

Another implementation of the present heat transfer apparatus that is related to that of FIGS. 2 and 5 entails two identical compressor-expander units like unit 20. Their cylinders are coaxially aligned, with their respective pistons linked to a common actuating shaft such that they share a common prime mover and move in a push-pull fashion, i.e., as one piston moves up, the other moves down and vice versa, and the pistons reach their opposite extrema at the same instant. The compressor-expanders 20 may have separate reservoirs, but preferably share a common reservoir 40. The compressor-expanders 20 are both connected to the heat exchangers 14, 16 by suitable piping. During each cycle of operation, each heat exchanger receives working fluid flow twice, once from each compressor-expander 20 during the intervals apparent from FIGS. 3A-3F, as described above.

Having thus described the invention in rather full detail, it will be understood that such detail need not be strictly adhered to but that further changes and modifications may suggest themselves to one skilled in the art, all falling within the scope of the invention as defined by the subjoined claims. Various components are described herein as useful in constructing the present heat transfer apparatus. These are not limiting; it is contemplated that one of ordinary skill in the relevant arts could make minor substitutions of additional components and/or structures and not substantially change the desired properties and functioning of the present heat transfer apparatus and method for the operation thereof to transfer heat energy from a heat source to a heat sink.

In the foregoing description, certain features of structure and process are described using spatially relative or directional terms such as "inner," "outer," "beneath," "below," "lower," "above," "upper," "up," "down," "top," and "bottom," and the like. The skilled person will understand these terms as having reference for explanatory purpose to the depiction of relevant items in the drawing figures, and their relationship to other elements. Such terms may be intended to encompass different orientations of the apparatus in installation, use, or operation in addition to the orientation(s) depicted in the figures, and that structures may be differently configured in certain embodiments of the disclosure as actually installed and operated.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Specific dimensions, specific materials, and/or specific shapes disclosed herein are exemplary in nature and do not limit the scope of the present disclosure. The disclosure herein of particular values and particular ranges of values for given parameters are not exclusive of other values and ranges of values that may be useful in one or more of the examples disclosed herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the descriptors "first" and "second," etc. are used herein in reference to various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context.

What is claimed is:

1. A heat transfer apparatus, comprising:

a) a compressor-expander having a cylindrical bore and a piston movable within the bore along a central axis thereof, the piston hermetically separating the bore into first and second volume portions that are fluidically connected through an intervening check valve that is configured to permit transfer of a working fluid from the first volume portion to the second volume portion; and wherein the cylindrical bore has: a liquid compressor inlet and a liquid compressor outlet situated respectively to receive working fluid into, and discharge working fluid out of, the first volume portion; and a vapor compressor outlet situated to discharge working fluid from the second volume portion;

b) a prime mover capable of being connected to an external power source and configured to drive the piston in reciprocating motion along the central axis;

c) a reservoir having a vapor return inlet, a liquid return inlet, and a liquid reservoir outlet that is in fluidic communication with the liquid compressor inlet through an intervening supply valve;

d) a vapor return providing a fluidic communication between the vapor compressor outlet, a vapor heat exchanger having a vapor heat exchanger inlet in fluidic communication with a vapor heat exchanger outlet, and the vapor return inlet controllable by an intervening regulating valve; and e) a liquid return providing fluidic communication between the compressor-expander and the reservoir, controllable by an intervening return valve.

2. The heat transfer apparatus of claim 1, wherein the liquid return comprises a liquid heat exchanger having a liquid heat exchanger inlet and a liquid heat exchanger outlet, wherein the liquid heat exchanger inlet is in fluidic communication with the liquid compressor outlet and the liquid heat exchanger outlet is in fluidic communication with the liquid return inlet.

3. The heat transfer apparatus of claim 2, wherein the return valve is interposed between the liquid compressor outlet and the liquid heat exchanger inlet.

4. The heat transfer apparatus of claim 2, wherein the return valve is interposed between the liquid heat exchanger outlet and the liquid return inlet.

5. The heat transfer apparatus of claim 1, wherein the vapor heat exchanger inlet is in fluidic communication with the vapor compressor outlet and the vapor heat exchanger outlet is in fluidic communication with the vapor-return inlet.

6. The heat transfer apparatus of claim 5, wherein the regulating valve is interposed between the vapor heat exchanger outlet and the vapor return inlet.

7. The heat transfer apparatus of claim 1, wherein the prime mover actuates the piston through a rotating crank and connecting rod.

8. The heat transfer apparatus of claim 7, further comprising a flywheel associated with the rotating crank.

9. The heat transfer apparatus of claim 1, wherein the vapor return inlet and the liquid return inlet are fluidically connected external to the reservoir to form a single reservoir inlet thereto.

10. The heat transfer apparatus of claim 1, wherein check valve is integral with the piston.

11. The heat transfer apparatus of claim 1, wherein the compressor-expander further comprises a bypass tube that fluidically connects the first and second volume portions and the check valve is situated in the bypass tube to control fluid flow therethrough.

12. The heat transfer apparatus of claim 1, further comprising an electronic control means and wherein at least one of the check valve, the supply valve, the regulating valve, and the return valve is electrically actuatable by the electronic control means.

13. The heat transfer apparatus of claim 12, further comprising a sensor configured to provide to the control means a signal indicative of the position of the piston within its reciprocal motion.

14. The heat transfer apparatus of claim 1, wherein the reservoir is configured to permit working fluid therein to be subjected to a preselected overpressure.

15. The heat transfer apparatus of claim 1, wherein the external power source comprises an electrical storage device adapted to store energy returned by the prime mover during a portion of the reciprocating motion of the piston.

16. A method for transferring heat energy from a heat source to a heat sink, comprising: providing a reservoir containing subcooled working fluid, a compressor-expander having a total volume variably apportioned between first and second volume portions, a vapor return, and a liquid return, wherein the first volume portion is fluidically connected to the reservoir through the liquid return and the second volume portion is fluidically connected to the reservoir through the vapor return, and carrying out repetitively a cycle comprising the steps of:

a) transferring a preselected amount of the subcooled working fluid from the reservoir to the first volume portion;

b) expanding the first volume portion to reduce adiabatically the pressure therein, whereby the working fluid is cooled and at least a portion thereof is converted to vapor;

c) contracting the second volume portion to increase adiabatically the pressure therein above a target pressure set point, whereby any working fluid therein is heated, and thereafter releasing the pressurized fluid to pass through the vapor return, via a vapor heat exchanger having a vapor heat exchanger inlet in fluidic communication with a vapor heat exchanger outlet, to the reservoir, whereby heat is rejected from the working fluid through the vapor return to the heat sink and pressure in the second volume portion is reduced below the target pressure set point;

d) thereafter, expanding the second volume portion and contracting the first volume portion;

e) equalizing the pressures of the working fluid between the first and second volume portions by fluidically connecting the first and second volume portions, so that the temperature of working fluid remaining in the second volume portion is increased; and f) thereafter, emptying the first volume portion by isobarically transferring the working fluid remaining therein through the liquid return to the reservoir, while removing ambient heat into the working fluid in the liquid return.

17. The method of claim 16, wherein at least part of steps (b) and (c) are carried out concurrently.

18. The method of claim 16, wherein the first and second volume portions are delimited by a piston movable within the compressor-expander.

19. The method of claim 18, wherein the piston is moved by a prime mover energized by an external power source.

20. The method of claim 18, wherein the expanding, contracting, and emptying of steps (a) through (f) are carried out by moving a piston within the compressor-expander.

21. The method of claim 20, wherein, in step (d), energy stored in the working fluid within second volume portion is converted to work that drives the piston.

22. The method of claim 16, wherein the emptying of step (f) comprises passing the working fluid from the first volume portion through a liquid heat exchanger to the reservoir.

23. The method of claim 19, wherein, during at least a portion of each cycle, energy derived from the working fluid is converted to mechanical work that impels the motion of the piston.

24. The method of claim 23, wherein, during at least a portion of each cycle, the motion of the piston causes the prime mover to generate electrical energy that is returned to the external energy source.

* * * * *